US006699061B2

(12) United States Patent
Abe et al.

(10) Patent No.: US 6,699,061 B2
(45) Date of Patent: Mar. 2, 2004

(54) CARD CONNECTOR

(75) Inventors: Kiyoshi Abe, Tokyo (JP); Shigeru Sato, Chiba (JP); Takashi Torii, Osaka (JP)

(73) Assignees: Yamaichi Electronics Co., Ltd., Tokyo (JP); Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/890,637

(22) PCT Filed: Dec. 5, 2000

(86) PCT No.: PCT/JP00/08608

§ 371 (c)(1),
(2), (4) Date: Oct. 12, 2001

(87) PCT Pub. No.: WO01/43235

PCT Pub. Date: Jun. 14, 2001

(65) Prior Publication Data

US 2002/0137386 A1 Sep. 26, 2002

(30) Foreign Application Priority Data

Dec. 6, 1999 (JP) ..... 11-346302

(51) Int. Cl.[7] ..... H01R 13/64
(52) U.S. Cl. ..... 439/377; 439/326
(58) Field of Search ..... 439/377, 157, 439/326, 327, 636

(56) References Cited

U.S. PATENT DOCUMENTS

| | | | | |
|---|---|---|---|---|
| 3,823,367 A | | 7/1974 | Kaye et al. | |
| 3,932,016 A | * | 1/1976 | Ammenheuser | 439/157 |
| 4,780,603 A | | 10/1988 | Hamada | |
| 4,864,116 A | | 9/1989 | Banjo et al. | |
| 5,036,430 A | | 7/1991 | Hills | |
| 5,198,645 A | | 3/1993 | Martin et al. | |
| 5,207,598 A | * | 5/1993 | Yamada et al. | 439/157 |
| 5,320,552 A | | 6/1994 | Reichardt et al. | |
| 5,374,198 A | * | 12/1994 | Nagata | 439/157 |
| 5,518,986 A | | 5/1996 | Winston | |
| 5,581,127 A | | 12/1996 | Shinohara | |
| 5,668,365 A | | 9/1997 | Ito et al. | |
| 5,718,609 A | | 2/1998 | Braun et al. | 439/630 |
| 5,872,353 A | | 2/1999 | Reichardt et al. | |
| 6,068,500 A | | 5/2000 | Kantner | |
| 6,089,919 A | | 7/2000 | Nishioka | |
| 6,126,486 A | | 10/2000 | Chang | |
| 6,129,571 A | | 10/2000 | Ikemoto | |
| 6,213,785 B1 | | 4/2001 | Nishio et al. | |
| 6,234,845 B1 | | 5/2001 | Hakozaki | |

FOREIGN PATENT DOCUMENTS

| | | |
|---|---|---|
| EP | 0 284 431 A2 | 9/1988 |
| JP | 63-133473 | 6/1988 |
| JP | 1-168978 | 11/1989 |

(List continued on next page.)

OTHER PUBLICATIONS

U.S. patent application Ser. No. 09/703,669, Ito et al., filed Nov. 2, 2000.
U.S. patent application Ser. No. 09/703,682, Ito et al., filed Nov. 2, 2000.
U.S. patent application Ser. No. 09/705,747, Ito et al., filed Nov. 6, 2000.
U.S. patent application Ser. No. 09/869,784, Ito et al., Jul. 5, 2001.
International Search Report Application No. PCT/JP00/07762, dated Feb. 6, 2001 from the European Patent Office.

*Primary Examiner*—Gary Paumen
*Assistant Examiner*—Briggitte R. Hammond
(74) *Attorney, Agent, or Firm*—Finnegan, Henderson, Farabow, Garrett & Dunner, LLP

(57) ABSTRACT

The base plate 31 of the connector housing is provided with the raised portion 50 that fits into one of the recessed portions 26 in the card 20 for the contact pads 27 when the card 20 is inserted. The raised portion 50 is made to function as a stopper to block the card from being inserted further when the card is wrongly inserted back to front, thereby preventing a possible deformation of the contact terminals on the connector side in the event that the card is wrongly inserted.

10 Claims, 11 Drawing Sheets

FOREIGN PATENT DOCUMENTS

| | | |
|---|---|---|
| JP | 2-187887 | 7/1990 |
| JP | 05-502746 | 5/1993 |
| JP | 06-044052 | 2/1994 |
| JP | 06-162281 | 6/1994 |
| JP | 07153524 | 6/1995 |
| JP | 7-335321 | 12/1995 |
| JP | 8-315081 | 11/1996 |
| JP | 9-7694 | 1/1997 |
| JP | 09007694 | 1/1997 |
| JP | 10-91729 | 4/1998 |
| JP | 10091729 | 4/1998 |
| JP | 10-187896 | 7/1998 |
| JP | 10240871 | 9/1998 |
| JP | 11-053503 | 2/1999 |
| JP | 11-316110 | 11/1999 |
| JP | 2000-277200 | 6/2000 |
| JP | 2001135385 | 5/2001 |

* cited by examiner

FRONT VIEW OF CONNECTOR

AFTER ENGAGEMENT

CARD NORMALLY INSERTED

BOTTOM VIEW OF CARD

CARD CONNECTOR

FIELD OF THE INVENTION

The present invention relates to a card connector mounted on electronic devices, such as cellular phones, telephones, PDAs (personal digital assistants), portable audio devices and cameras, and more specifically to a structure that prevents contact terminals of the card connector from being deformed by a wrong insertion of a card.

BACKGROUND ART

In electronic devices such as cellular phones, telephones, PDAs and digital cameras, a variety of functions are added by inserting an IC card with a built-in CPU or memory IC, such as a SIM (subscriber identity module) card, an MMC (multimedia card), and an SD (secure digital or super density) card.

In a connector for removably accommodating such an IC card, a plurality of contact terminals made from a metal leaf spring are provided in a connector housing to make contact with a plurality of contact pads formed on the front or back surface of the inserted IC card to electrically connect the IC card to the electronic device mounting that connector. The contact pads of the IC card include a power supply pad connected to a power supply line and a plurality of signal pads for transferring various signals. These contact pads are connected via the contact terminals of the card connector to a power supply circuit and various signal processing circuits in the electronic device.

The SD card, one kind of the IC card, is shaped as shown in FIGS. 8A to 8C and FIG. 9. FIG. 8 shows a top view of the card and FIG. 9 shows a bottom view of the card.

In these figures, the SD card 20 has an upper body portion 21 with a thickness of a. At the front right corner the card has a virtually triangular cut-off corner portion 22 for preventing its erroneous insertion. On the back surface side of the upper body portion 21 is formed a lower body portion 23 having a thickness slightly narrower than that of the upper body portion 21 and a predetermined thickness b. That is, the card 20 has stepped portions 24 formed along its both side edges.

On the front part of the lower body portion 23 a plurality of recessed portions (grooves) 26 are formed, separated from each other by a plurality of partition walls 25. On the bottom surface of these recessed portions 26 are arranged contact pads 27 connected to an IC circuit inside the card. The depth of each recessed portion 26 is almost equal to the height of the lower body portion 23 and therefore the surface of each contact pad 27 is spaced from the front surface of the upper body portion 21 by a distance equal to the thickness a of the upper body portion 21. On a side surface of the card 20 is arranged a slidable write protect button 28 which is slid to one position to protect the card 20 against being written with data.

As an example of connector for accommodating a double-height structure card, such as the SD card described above, the applicant of this invention filed Japanese Patent Application No. 11-316110 entitled "Card Connector Structure" on Nov. 5, 1999.

According to the invention of this application, in order to provide a connector that can be used commonly for a double-height thick card 20 such as the SD card above and for a single-height thin card (e.g., MMC card) having almost the same thickness a as the upper body portion 21 of the SD card 20, both side wall portions of a connector housing are formed with a pair of guide grooves that support and guide both side edges of the upper body portion 21 of the double-height thick card 20 and both side edges of the single-height thin card as they are inserted or withdrawn. These guide grooves support those portions of the two cards which have the same thicknesses a. In this connector, when each of these cards is supported in the connector, the distance from the contact pads 27 of one card to the contact terminals of the connector is equal to the distance from the contact pads 27 of the other card to the contact terminals, so that the both cards engage the contact terminals with the same contact pressures.

FIGS. 10A and 10B show the double-height thick card 20 normally inserted into connector 100 of this invention. A base plate of a connector housing 101 has a plurality of contact terminals 102 arranged parallelly thereon. The connector housing 101 has an abutment wall 103 against which the inserted IC card 20 is pushed. At one corner of the abutment wall 103 there is formed a protruding corner wall 104 with which the cut-off corner portion 22 of the IC card 20 engages. In both side wall portions, the above-described guide grooves 105 are formed. These paired guide grooves 105 support both edges of the upper body portion 21 of the card 20.

In FIG. 10A and FIG. 10B the card 20 is shown to be normally inserted, so contact portions 102*a* of the contact terminals 102 of the connector 100 engage with the contact pads 27 of the SD card 20 with an appropriate pressure.

In the connector above, when the card 20 is wrongly inserted back to front as shown in FIG. 11A and FIG. 11B, the card 20 can be inserted into the connector 100 until its rear end wall 29 abuts against the corner wall 104.

When the card is inserted back to front to such a position, however, the contact portions 102*a* of the contact terminals 102 are in an overloaded state where they are pressed excessively by the bottom surface of the card 20. In this state, the contact terminals 102 are deformed excessively beyond the elastic limit and undergo plastic deformations.

The present invention has been accomplished to overcome this problem. It is therefore an object of this invention to solve the problem by providing a card connector which, if the card is wrongly inserted back to front, can reliably prevent excess deformations of the contact terminals.

DISCLOSURE OF THE INVENTION

According to one aspect, the present invention provides a card connector for holding a card in a connector housing in such a way that contact pads of the card engage with contact terminals arranged in the connector housing, wherein the card has a plurality of recessed portions formed parallelly in a front part thereof with the contact pads arranged in the recessed portions, the card connector comprising: a pair of guide grooves formed in the connector housing to support and guide both side edges of the card; and a raised portion formed in the connector housing to fit into one of the plurality of recessed portions of the card when the card is inserted into the connector.

With this invention, when the card is inserted normally, the raised portion fits into one of the recessed portions in the card for the contact pads. At this time, the contact pads of the card are brought into contact with the contact terminals of the connector without interference from the raised portion.

When the card is wrongly inserted back to front, on the other hand, the raised portion works as a stopper and stops the card being inserted before the contact terminals are displaced by the card in excess of their elastic limit.

PREFERRED EMBODIMENT OF THE INVENTION

Now, one embodiment of this invention will be described in detail by referring to the accompanying drawings.

Figure 1:
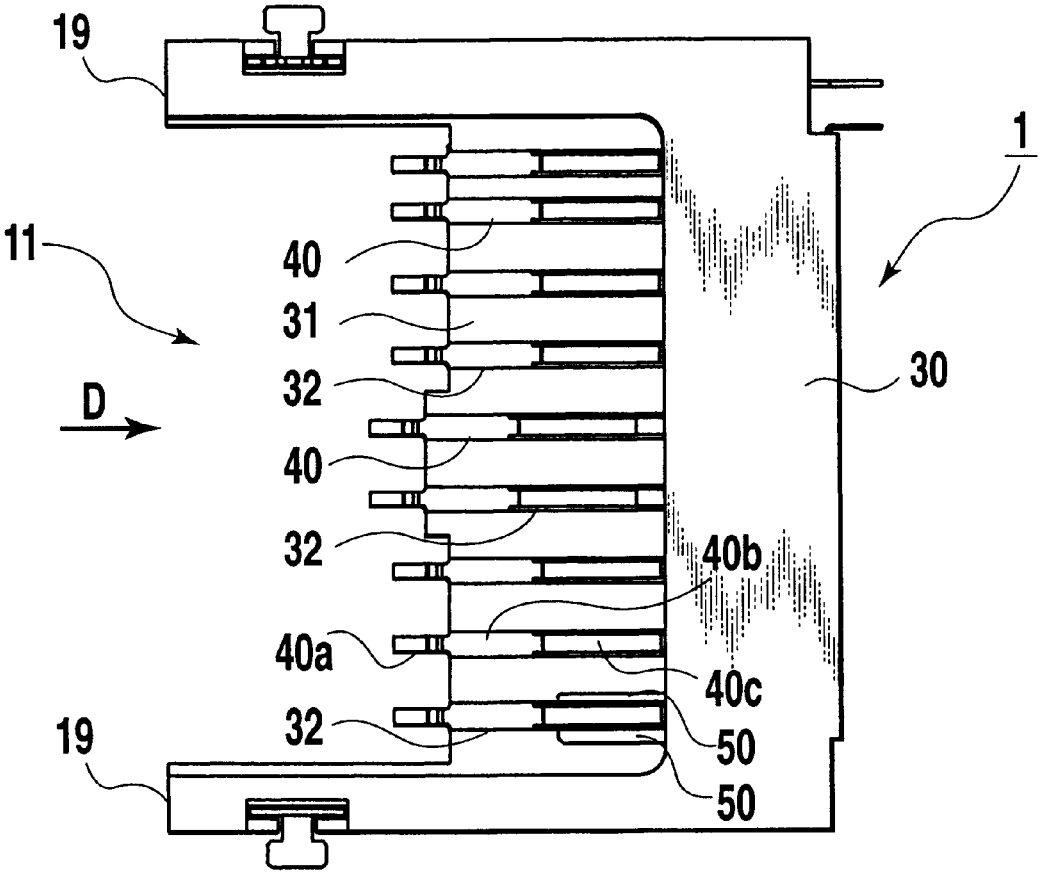
FIG. 1 is a plan view showing one embodiment of a card connector according to this invention.
Figure 2:
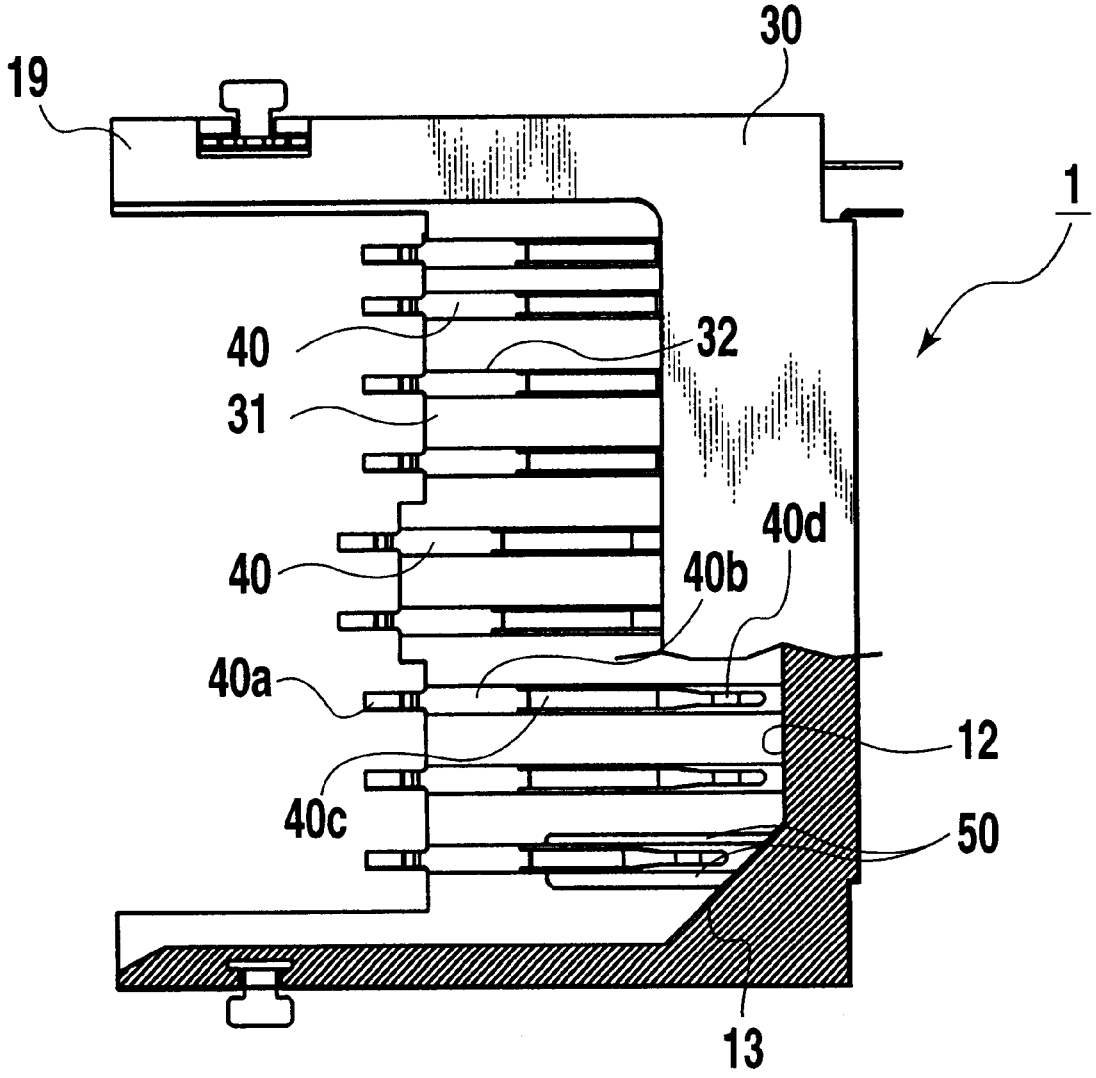
FIG. 2 is a partly cutaway plan view of the embodiment of FIG. 1.
Figure 3:
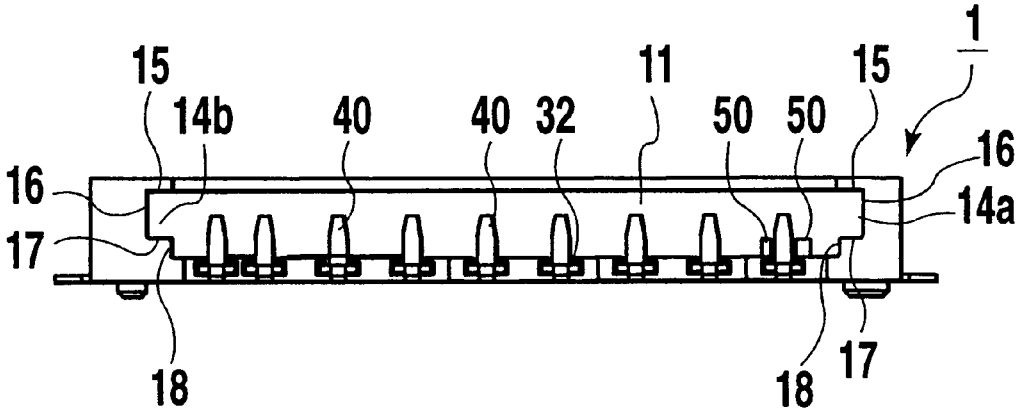
FIG. 3 is a front view of the embodiment of FIG. 1.
Figure 4:
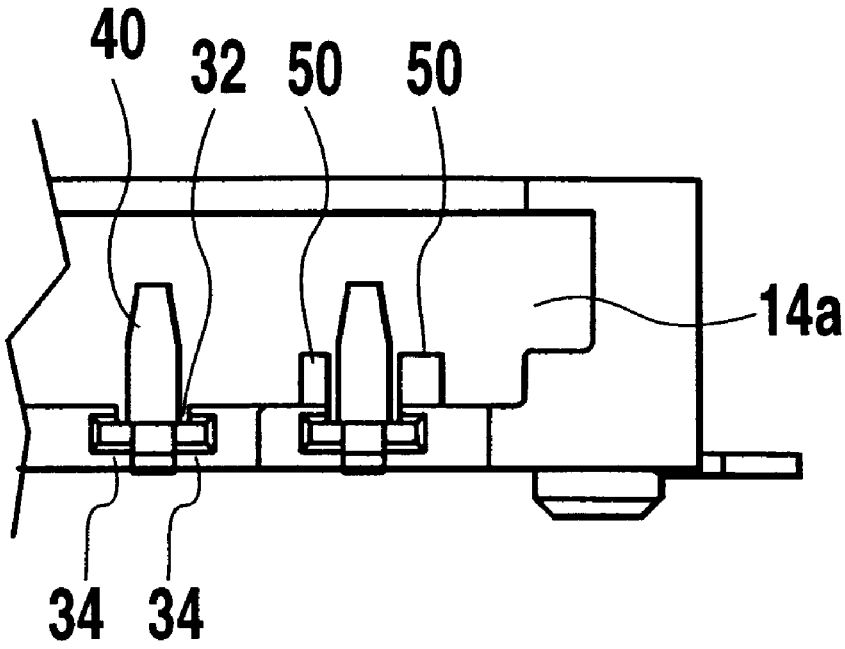
FIG. 4 is a partially enlarged view of FIG. 3.
Figures 5A, 5B:
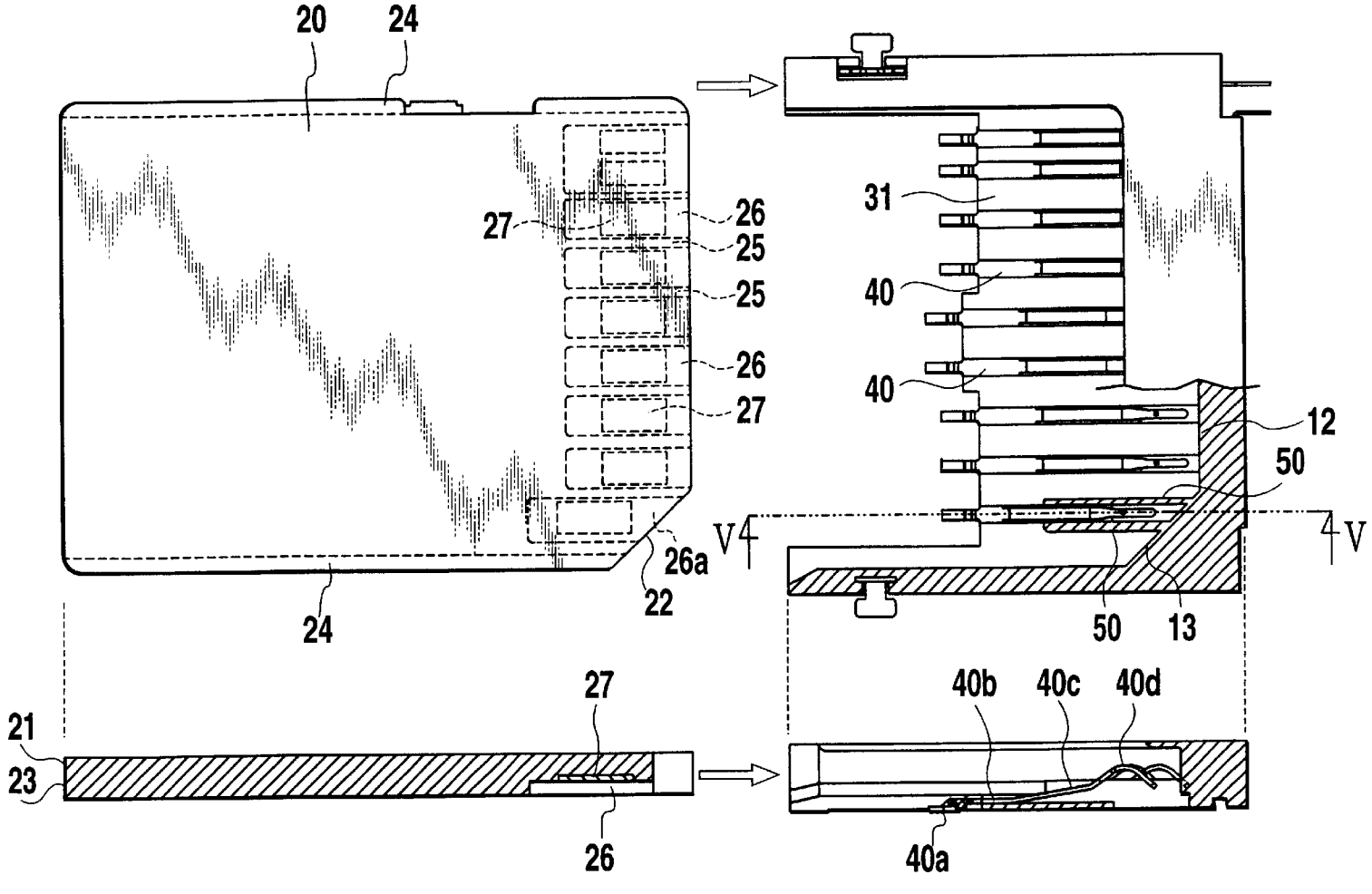
FIG. 5A is a plan view showing the state of the connector and a card before the card is inserted into the connector.
FIG. 5B is a cross section showing the same state as FIG. 5A.

FIG. 1 is a plan view showing one embodiment of the card connector according to this invention; FIG. 2 is a partly cutaway plan view showing essential parts of the invention; FIG. 3 is a front view of the connector as seen from the direction of arrow D in FIG. 1; and FIG. 4 is a partially enlarged view of FIG. 3. FIGS. 5A and 5B show the state of the connector before the IC card is inserted into it. FIG. 5B is a cross section taken along the line V—V of FIG. 5A.

The card connector 1 is mounted on electronic devices such as cellular phones, PDAs, portable audio devices and digital cameras.

The connector 1 shown in FIG. 1 to FIG. 5 can accommodate a double-height thick card 20 with stepped portions, such as an SD card shown in FIGS. 8A to 8C and FIG. 9. The connector 1 can also accommodate a single-height thin card, such as an MMC card, that has virtually the same shape, size and thickness a as those of the upper body portion 21 of the SD card 20.

In FIG. 1 to FIG. 5, the card connector 1 has a connector housing 30 integrally formed as one piece from an insulating material such as resin. The connector housing 30 is roughly U-shaped in a plan view so as to have side leg portions.

The IC card 20 is inserted into the connector 1 through a card insertion opening 11 formed at the front of the housing 30.

The connector housing 30, as shown in FIG. 5, has an abutment wall 12 that connects both side leg portions and with which the front end portion of the inserted IC card engages. At one corner of the abutment wall 12 where the abutment wall 12 and the side leg portion intersect, a protruding corner wall 13 is formed which engages with the cut-off corner portion 22 of the IC card 20.

As shown in FIG. 3, the IC card 20 is guided and supported at both side edges by a pair of guide grooves 14*a*, 14*b* formed in inner side walls of both side leg portions of the housing 30 as it is inserted and retracted.

One of the guide grooves 14*a* extends from a housing front end 19 to the corner wall 13 and the other guide groove 14*b* extends from the housing front end 19 to the abutment wall 12. The guide grooves 14*a*, 14*b* are formed by upper walls 15, side walls 16 and lower walls 17 and have their openings directed toward each other.

From the edge of the lower wall 17 of each guide groove 14*a*, 14*b* a second side wall 18 extends vertically downwardly almost at a right angle. For each of the second side walls 18, a second lower wall is formed, and the upper surface of the second lower wall is flush with the upper surface of a base plate 31 of the housing 30. A space is formed between the two parallel second side walls 18.

The base plate 31 forming the bottom wall of the housing 30 has a plurality of grooves 32 in which a plurality of contact terminals 40 are securely fitted. The contact terminals 40 include power supply terminals and signal terminals. Each of the contact terminals 40 has a terminal portion 40*a* soldered to a contact pad on a printed circuit board of the electronic device, a fixed portion 40*b* securely held in the groove 32, and a contact spring portion 40*c* elastically displaced to make contact with the contact pad 27 of the card 20. The contact spring portion 40*c* has a contact portion 40*d* protruding upward in an arc from the fixed portion 40*b*.

Both side walls forming each of the grooves 32, as shown in FIG. 4, have press-fit grooves (recessed portions) 34 in which left and right side edges of the fixed portion 40*b* of the contact terminal 40 are fitted under pressure. These recessed portions 34 rigidly support the fixed portion 40*b* of each contact terminal 40.

These contact terminals 40 make electrical connection between the card 20 and the electronic device and at the same time provide an appropriate card holding force by their elasticity.

On both sides of the groove 32 that rigidly supports the rightmost contact terminal 40, when viewed from the card insertion opening 11, a pair of raised portions (referred to as ribs) 50 are arranged on the base plate 31 to extend along both sides of the contact terminal 40. The ribs 50 are formed integral with the base plate 31. The pair of the ribs 50 have their positions, widths and heights so set that when the card 20 is normally inserted, they fit into one 26*a* of grooves 26 formed between separation walls 25 of the card 20 which is located near the cut-off corner portion 22 (see FIG. 5A and FIG. 5B).

These paired ribs 50 function as stoppers that, when the card 20 is wrongly inserted back to front, prevent the card 20 from being inserted to the fully inserted position.

Figure 6A:
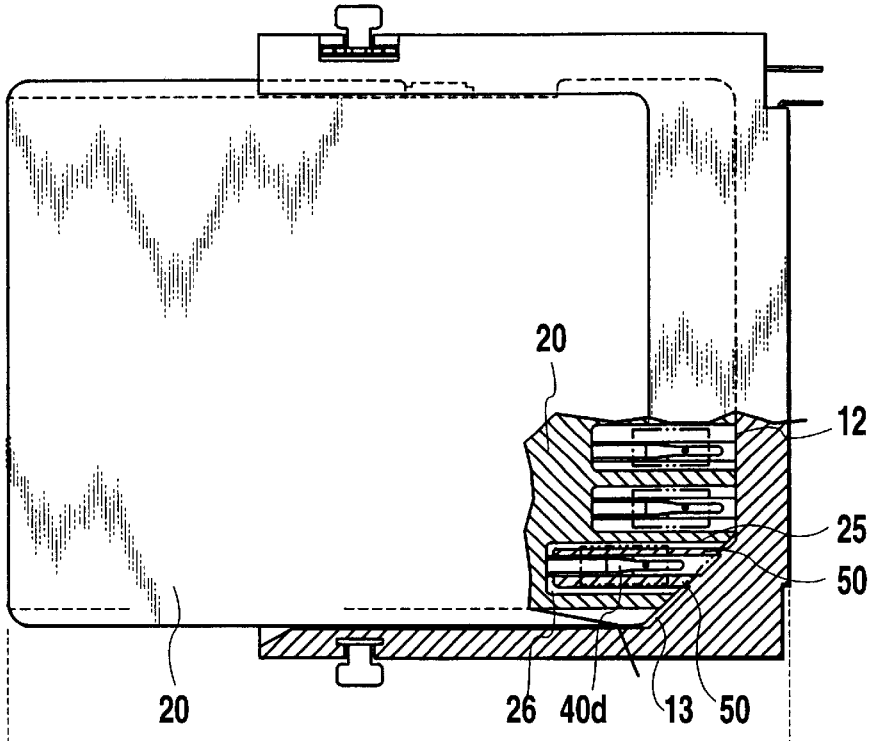
FIG. 6A is a partly cutaway plan view showing the state of the connector and the card when the card is normally inserted.
Figure 6B:
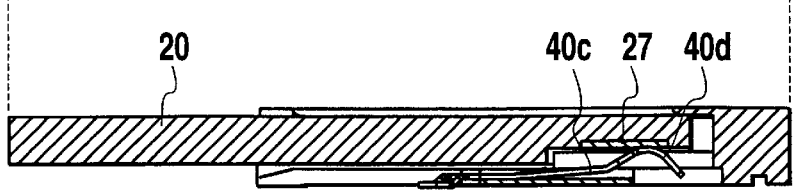
FIG. 6B is a cross section showing the same state as FIG. 6A.

FIG. 6A and FIG. 6B show the card 20 normally inserted into the connector.

When the card 20 is normally inserted into the connector 1, the side surfaces of the upper body portion 21 of the card 20 are guided by the side walls 16 of the guide grooves 14*a*, 14*b* and the side edge portions of the bottom surface of the upper body portion 21, i.e., the stepped portions 24, are supported and guided by the lower walls 17. The floating of the card 20 due to the elastic force of the contact terminals 40 is prevented by the side edge portions of the top surface of the upper body portion 21 being restricted by the upper walls 15 of the guide grooves 14*a*, 14*b*. The lower body portion 23 of the card 20 is accommodated in the space between the second side walls 18.

The card 20 can be inserted into the connector to a position where its cut-off corner portion 22 and front end wall engage with the corner wall 13 and the abutment wall 12, respectively. With the card 20 inserted to this position, the pair of ribs 50 formed on the base plate 31 of the housing 30 fit into the groove 26*a* of the card 20 adjoining the cut-off corner portion 22 of the card 20. At this time, the contact portion 40*d* of the contact terminal 40 projecting from between the paired ribs 50 is pressed and elastically deformed by the contact pad 27 provided in the groove 26*a* of the card 20, making elastic contact with the contact pad 27 with an appropriate contact pressure. Other contact terminals 40 not provided with the ribs 50 also engage with associated contact pads 27 with an appropriate contact pressure.

Figures 7A, 7B:
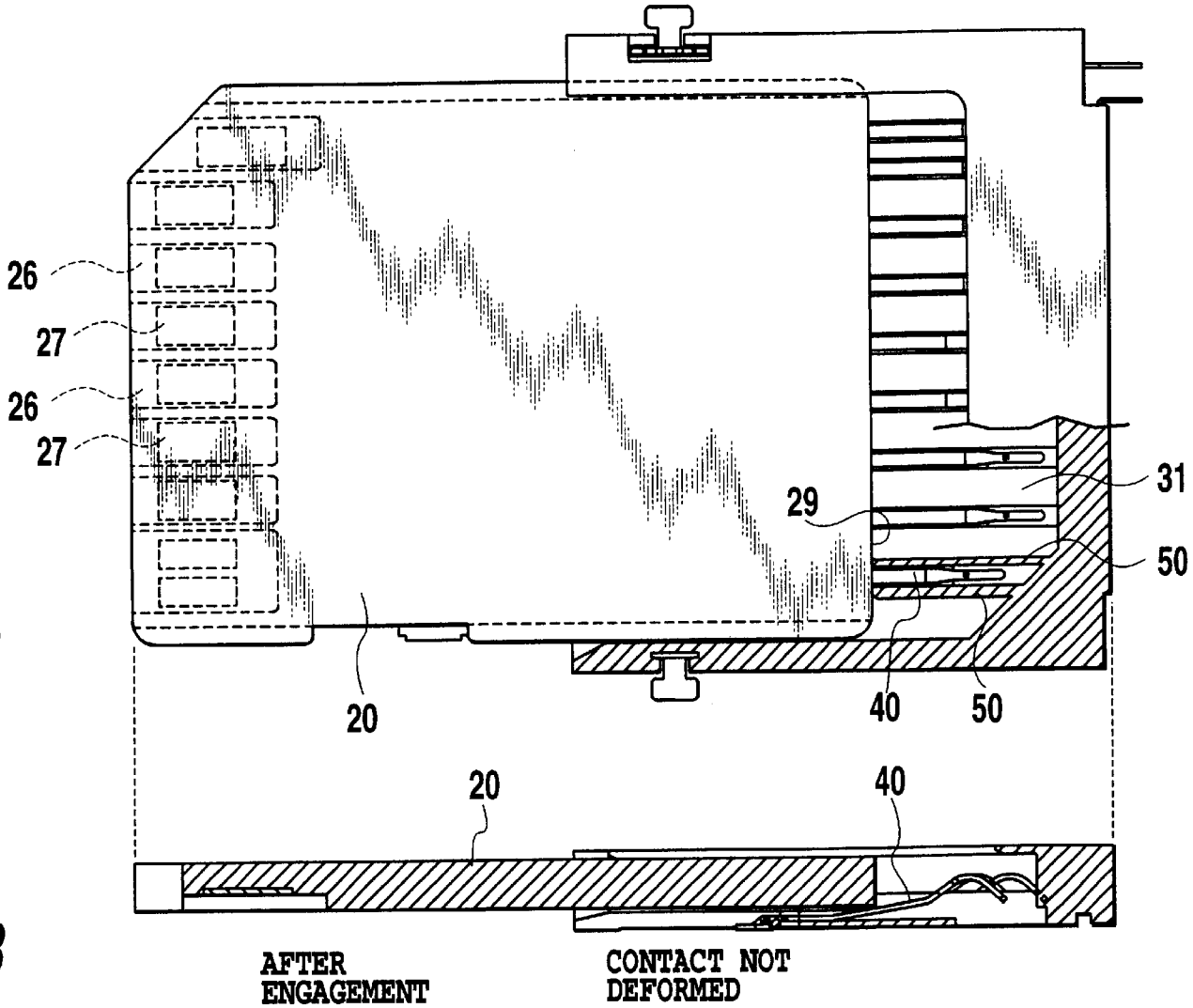
FIG. 7A is a partly cutaway plan view showing the state of the connector and the card when the card is wrongly inserted.
FIG. 7B is a cross section showing the same state as FIG. 7A.
Figure 8A:
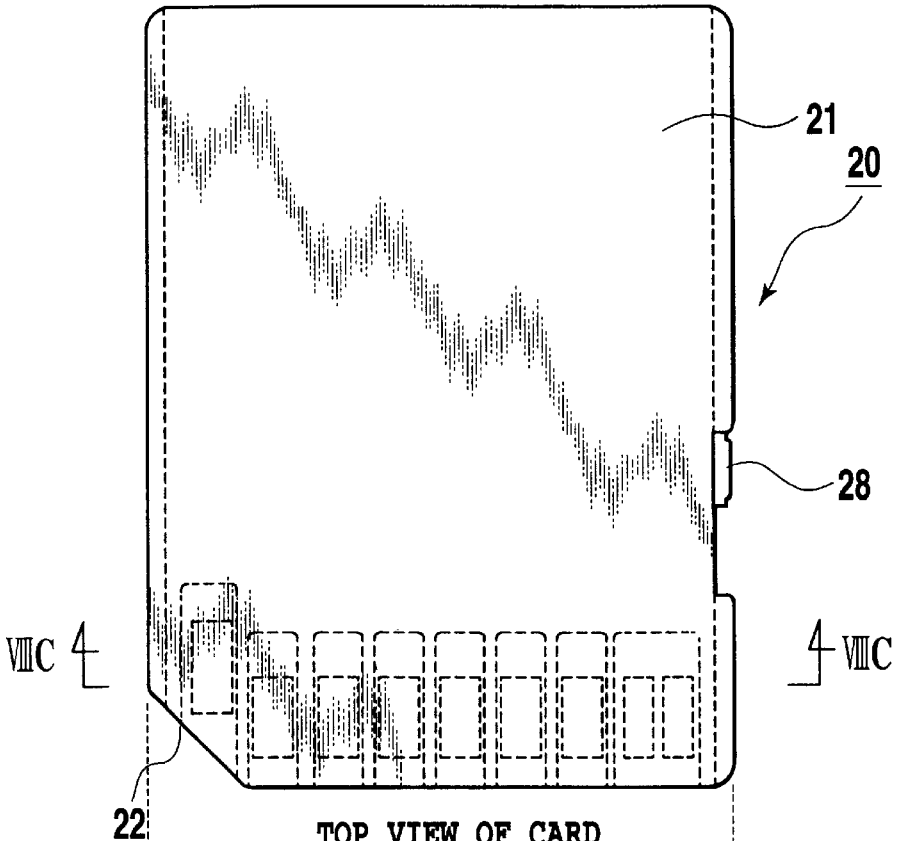
FIGS. 8A, 8B and 8C are a plan view, a front view and a cross-sectional view of a double-height thick card, respectively.
Figure 8B:
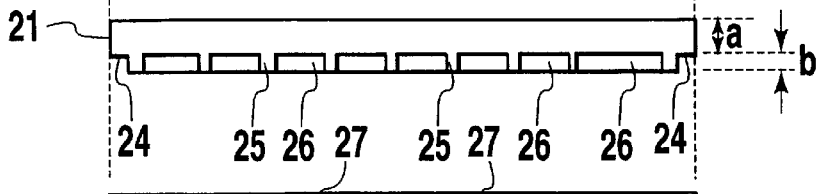
Figure 8C:
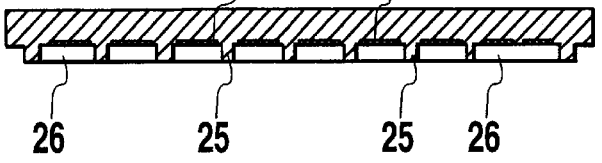
Figure 9:
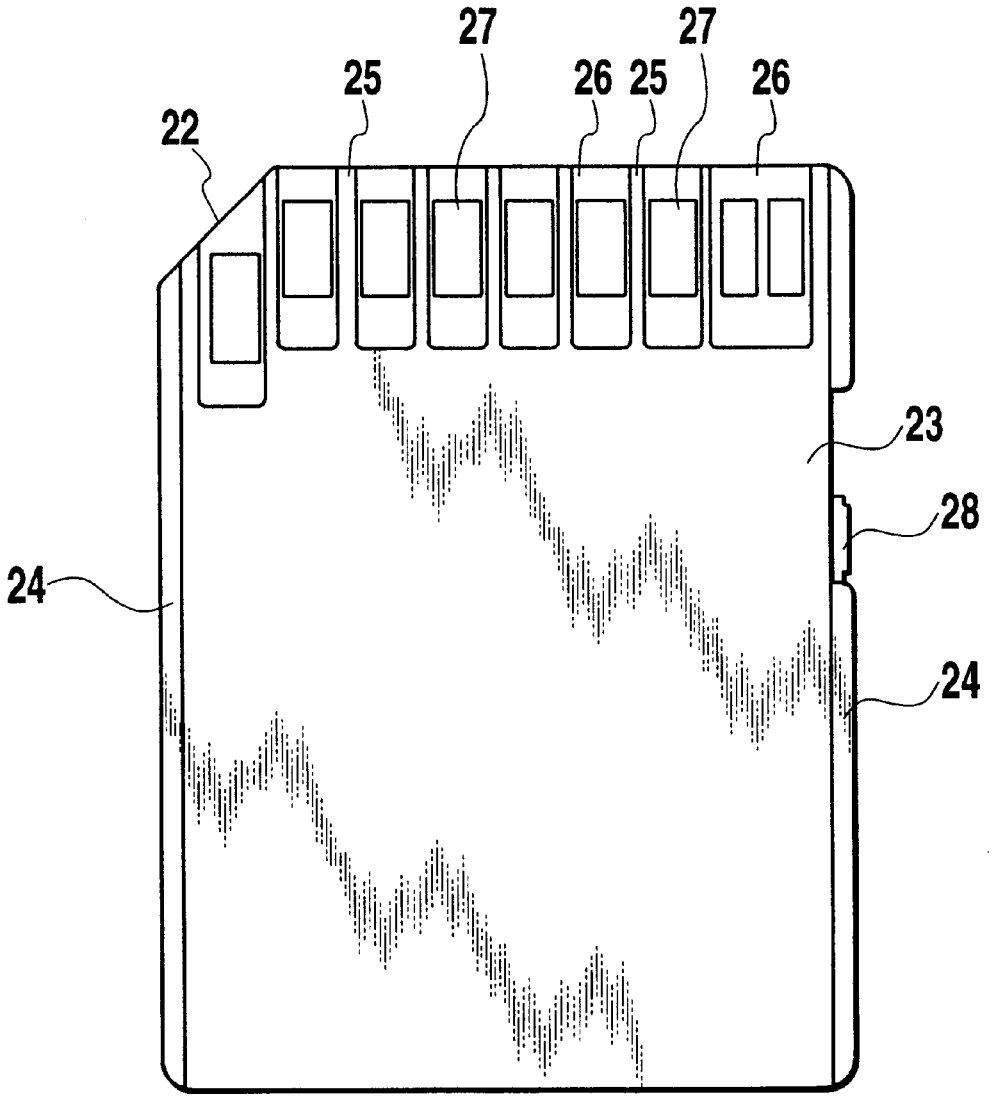
FIG. 9 is a bottom view of the double-height thick card.
Figures 10A, 10B:
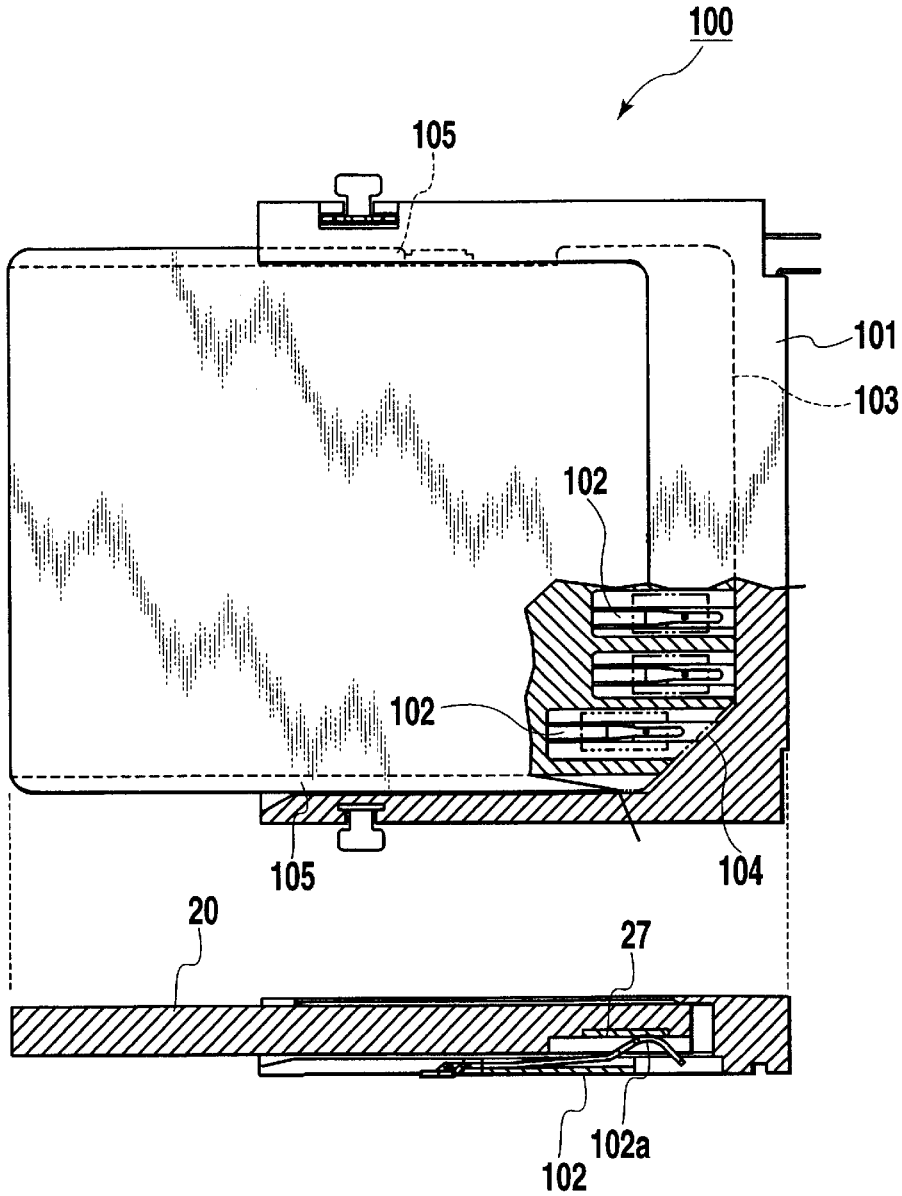
FIG. 10A is a partly cutaway plan view showing a connector of a previous invention.
FIG. 10B is a cross section of FIG. 10A.
Figure 11A:
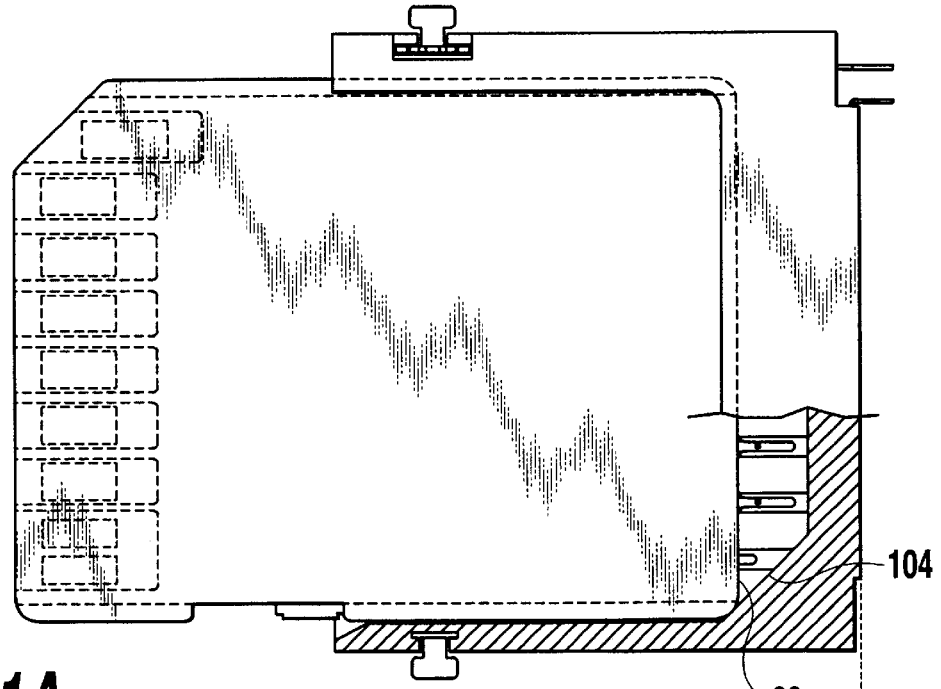
FIG. 11A is a partly cutaway plan view showing the card wrongly inserted into the connector of the previous invention.
Figure 11B:
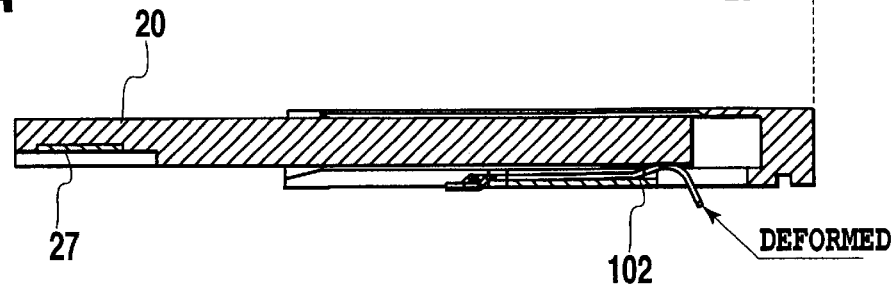
FIG. 11B is a cross section of FIG. 11A.

FIG. 7A and FIG. 7B show the card 20 wrongly inserted back to front into the connector.

In this case, too, the card 20 can be inserted into the connector with the upper body portion 21 supported by the guide grooves 14*a*, 14*b*. However, because the rear part of the card 20 is not formed with the grooves 26 as is the front part, if the card 20 is wrongly inserted back to front, the rear end wall 29 of the card 20 abuts against the front end face of the ribs 50 at some point on the way, blocking a further insertion of the card. Hence, with this connector, because the card 20 cannot be inserted any further as it can with the conventional connector, the contact terminals 40 can be prevented from being overloaded and displaced beyond its elastic limit.

In this embodiment, because the stopper structure formed by the pair of ribs 50 is provided, if the card is wrongly inserted back to front, it is possible to block the insertion of the card 20 before the contact terminals 40 are displaced in excess of their elastic limit, thus preventing plastic deformation of the contact terminals 40.

In the connector 1 of the embodiment above, because the cantilevered contact terminals 40 are arranged to have the terminal portion 40*a* on the front side of the connector 1 and the contact portion 40*d* on the rear side of the connector 1, the area occupied by the connector 1 can be made smaller than when their arrangements are reversed. That is, when the orientations of the contact terminals 40 are reversed from the above, the terminal portion 40*a* is exposed outside the housing of the connector 1 and the occupied area increases to that extent.

The ribs 50 can be made to function as the stopper as long as the ribs 50, when the card 20 is inserted, can fit into any one of the grooves 26 without hindering the contact between the contact terminals 40 and the contact pads 27. That is, the ribs 50 do not need to be provided in a pair on both sides of the contact terminal 40 as in the embodiment above but may be arranged to cover the contact terminal 40 from above (i.e., the ribs may cross the contact terminal 40).

But, providing the ribs 50 at the sides of the groove 32, in which the contact terminal 40 is press-fitted, as in the embodiment above has the advantage of facilitating the process of press-fitting the contact terminal 40 in the card insertion direction into the recessed portions 34 formed in the inner walls of the groove 32 because there is no hindrance above the contact terminal 40.

While in the embodiment above the ribs 50 are provided on both sides of the contact terminal 40, a rib 50 may be provided on one side only.

Further, although in the embodiment above the ribs 50 are provided adjoining the contact terminal 40 whose contact portion 40*d* is situated nearest to the front side of the connector (card insertion opening side) among the plurality of contact terminals 40 (in this case, a contact terminal 40 situated in front of the corner wall 13), they may be arranged to adjoin any other contact terminal 40. Alternatively, the ribs 50 may be provided at different positions adjoining a plurality of contact terminals 40.

While in the embodiment above, the ribs 50 are applied to the connector construction that supports both side edges of the upper body portion 21 of the card 20 by the guide grooves 14*a*, 14*b* formed in the connector housing 30, they can also be applied, with similar effects, to a connector construction that supports the bottom surface of the card 20, i.e., the lower body portion 23.

While in the embodiment above the top plate of the connector housing 30 covers only the guide grooves 14*a*, 14*b*, the abutment wall 12 and its vicinity, it may cover entire surface or most of the card.

Further, the connector housing may be constructed of a plurality of housing members, for example, an upper housing made from a worked metal plate and a lower housing made from resin.

In the embodiment above, because the card 20 is inserted with its contact pad arranged surface facing down, the contact terminals 40 are arranged on the base plate 31 of the connector housing 30. In a connector in which the card 20 is inserted with its contact pad arranged surface facing up, the contact terminals 40 may be arranged on the top plate of the connector housing 30. In such a connector, the pair of ribs 50 need to be provided on the top plate of the connector housing 30.

Further, while the embodiment above uses the connector for the SD card, the present invention can be applied to connectors for any card as long as the card is of a type that has a plurality of recessed portions 26 formed in its front part with contact pads 27 arranged at the bottoms of the recessed portions 26. For example, the present invention can also be applied to a connector designed for use with a card which has no stepped portions 24 at its side edges.

Industrial Applicability

As explained above, because the connector housing is provided with a raised portion which, when the card is inserted into the connector, fits into one of the recessed portions formed at the contact pad portions of the card, this raised portion works as a stopper when the card is wrongly inserted back to front. This stopper stops the card being inserted before the contact terminals are displaced in excess of their elastic limit. Thus, the plastic deformation of the contact terminals can be prevented reliably.

What is claimed is:

1. A card connector comprising:

a connector housing;

a plurality of contact terminals arranged in the connector housing and configured to engage a plurality of contact pads on a card; and a raised portion formed in the connector housing such that the raised portion fits into one of a plurality of recessed portions of a properly inserted card, wherein the raised portion is a pair of ribs.

2. A card connector according to claim 1, wherein the raised portion is arranged adjacent to one of the contact terminals.

3. A card connector according to claim 1, wherein the connector housing has a plurality of grooves to rigidly secure and support the contact terminals and the raised portion is arranged in the connector housing adjacent to one of the grooves.

4. A card connector according to claim 1, wherein the raised portion is a pair of ribs, and one of the contact terminals is disposed within a space between the pair of ribs.

5. A card connector according to any one of claims 1 to 4, wherein the contact terminals are elastic leaf springs extending in a card insertion direction, and each of the elastic leaf springs has a terminal portion situated on a front side in the card insertion direction for electrical connection and a contact portion situated on a rear side for engagement with an associated contact pad.

6. A card connector according to any one of claims 1 to 4, wherein the raised portion is formed on a base plate of the connector housing.

7. A card connector according to claim 1, wherein the card has an upper body portion slightly narrower than the upper body portion and having the plurality of recessed portions;

wherein the pair of guide grooves of the card connector are configured to support and guide both side edges of the upper body portion of the card as the card is inserted and retracted; and wherein the connector housing has side walls defining a space to accommodate the lower body portion of the card below another space formed between the pair of guide grooves.

8. A card connector for holding a card having a plurality of recessed portions and a plurality of contact pads arranged in the recessed portions, the card connector comprising:

a connector housing;

a plurality of contact terminals arranged in the connector housing and configured to engage with the contact pads arranged in the recessed portions of a card;

a pair of guide grooves formed in the connector housing to support and guide both side edges of a card; and a raised portion formed in the connector housing such that the raised portion and at least one contact terminal fits into one of the recessed portions of a card when the card is normally inserted into the connector.

9. A card connector for holding a card having a plurality of recessed portions and a plurality of contact pads arranged in the recessed portions, the card connector comprising:

a connector housing;

a plurality of contact terminals arranged in the connector housing and configured to engage with the contact pads arranged in the recessed portions of a card, wherein the contact terminals are elastic leaf springs extending in a card insertion direction, and each of the elastic leaf springs has a terminal portion situated on a front side in the card insertion direction for electrical connection and a contact portion situated on a rear side for engagement with an associated contact pad;

a pair of guide grooves formed in the connector housing to support and guide both side edges of a card; and a raised portion formed in the connector housing such that the raised portion fits into one of the recessed portions of a card when a card is normally inserted into the connector, wherein the raised portion is a pair of ribs, and one of the contact terminals is disposed within a space between the pair of ribs.

10. A card connector for holding a card having a plurality of recessed portions and a plurality of contact pads arranged in the recessed portions, the card connector comprising:

a connector housing;

a plurality of contact terminals arranged in the connector housing and configured to engage with the contact pads arranged in the recessed portions of a card;

a pair of guide grooves formed in the connector housing to support and guide both side edges of a card; and a raised portion formed in the connector housing such that the raised portion fits into one of the recessed portions of a card when the card is normally inserted into the connector, wherein the raised portion is formed on a base plate of the connector housing and comprises a pair of ribs, and one of the contact terminals is disposed within a space between the pair of ribs.

* * * * *

UNITED STATES PATENT AND TRADEMARK OFFICE

CERTIFICATE OF CORRECTION

PATENT NO. : 6,699,061 B2
DATED : March 2, 2004
INVENTOR(S) : Kiyoshi Abe et al.

It is certified that error appears in the above-identified patent and that said Letters Patent is hereby corrected as shown below:

Column 7,
Line 25, "portion slightly" should read -- portion and a lower body portion slightly --.

Signed and Sealed this

Seventeenth Day of August, 2004

JON W. DUDAS
*Acting Director of the United States Patent and Trademark Office*